US008876551B2

(12) United States Patent
Berger et al.

(10) Patent No.: US 8,876,551 B2
(45) Date of Patent: Nov. 4, 2014

(54) WALL-SHAPED HIGH-FREQUENCY ASSEMBLY HAVING A MOUNTING WALL WITH INTEGRALLY FORMED SLEEVES

(75) Inventors: Stefan Berger, Rohrdorf (DE); Thomas Haunberger, Bad Reichenhall (DE); Juergen Hefele, Waakirchen (DE); Manfred Stolle, Bad Aibling (DE)

(73) Assignee: Kathrein-Werke KG, Rosenheim (DE)

( * ) Notice: Subject to any disclaimer, the term of this patent is extended or adjusted under 35 U.S.C. 154(b) by 46 days.

(21) Appl. No.: 13/640,238

(22) PCT Filed: Feb. 24, 2011

(86) PCT No.: PCT/EP2011/000915

§ 371 (c)(1), (2), (4) Date: Oct. 9, 2012

(87) PCT Pub. No.: WO2011/124299

PCT Pub. Date: Oct. 13, 2011

(65) Prior Publication Data

US 2013/0029526 A1 Jan. 31, 2013

(30) Foreign Application Priority Data

Apr. 8, 2010 (DE) ..... 10 2010 014 154

(51) Int. Cl.

| | |
|---|---|
| ***H01R 9/05*** | (2006.01) |
| ***H01R 24/52*** | (2011.01) |
| *H01R 13/50* | (2006.01) |
| *H01R 103/00* | (2006.01) |

(52) U.S. Cl.

CPC ..... *H01R 24/52* (2013.01); *H01R 13/50* (2013.01); *H01R 2103/00* (2013.01)

USPC ..... 439/579

(58) Field of Classification Search

CPC ..... H01R 2103/00

See application file for complete search history.

(56) References Cited

U.S. PATENT DOCUMENTS

| | | | | |
|---|---|---|---|---|
| 3,663,928 | A * | 5/1972 | Keto et al. | 439/184 |
| 4,662,703 | A * | 5/1987 | Forney et al. | 439/578 |

(Continued)

FOREIGN PATENT DOCUMENTS

| | | |
|---|---|---|
| DE | 1 246 077 | 3/1968 |
| DE | 197 46 637 | 2/1999 |

(Continued)

OTHER PUBLICATIONS

Translation of Written Opinion of the International Searching Authority for PCT/EP2011/000915, mailed Jun. 6, 2011.

*Primary Examiner* — Chandrika Prasad

(74) *Attorney, Agent, or Firm* — Nixon & Vanderhye P.C.

(57) ABSTRACT

A wall-shaped HF assembly is characterized by the following features, among others: the mounting wall and the at least two connection sleeves of the wall-shaped HF assembly are both made of the same electrically conductive metal material, the at least two connection sleeves are formed as one piece together with the mounting wall, specifically in the form of a material connection, the mounting wall and the at least two connection sleeves are provided with an electrically non-conductive surface coating.

16 Claims, 7 Drawing Sheets

(56) References Cited

U.S. PATENT DOCUMENTS

| | | | | |
|---|---|---|---|---|
| 6,969,278 | B2 * | 11/2005 | Shapson | 439/579 |
| 7,163,418 | B2 * | 1/2007 | Macor | 439/536 |
| 7,186,139 | B2 * | 3/2007 | Chen et al. | 439/541.5 |
| 7,404,738 | B2 * | 7/2008 | Montena | 439/579 |
| 7,520,779 | B2 * | 4/2009 | Arnaud et al. | 439/578 |
| 8,038,473 | B2 * | 10/2011 | Amidon | 439/578 |
| 2003/0181073 | A1 | 9/2003 | Nagano | |
| 2008/0261446 | A1 | 10/2008 | Arnaud et al. | |

FOREIGN PATENT DOCUMENTS

| | | |
|---|---|---|
| DE | 699 02 947 | 1/2003 |
| DE | 10 2005 039 458 | 3/2008 |
| DE | 10 2007 016 430 | 2/2009 |
| EP | 1 724 877 | 11/2006 |
| EP | 2 117 084 | 11/2009 |
| FR | 2 926 403 | 7/2009 |
| WO | WO 2008/094650 | 8/2008 |

* cited by examiner

WALL-SHAPED HIGH-FREQUENCY ASSEMBLY HAVING A MOUNTING WALL WITH INTEGRALLY FORMED SLEEVES

This application is the U.S. national phase of International Application No. PCT/EP2011/000915, filed Feb. 24, 2011, which designated the U.S. and claims priority to German Application No. 10 2010 014 154.2, filed 8 Apr. 2010, the entire contents of each of which are hereby incorporated by reference.

The invention relates to a wall-shaped HF assembly comprising at least one HF connection sleeve in accordance with the preamble of claim 1.

Plug-in connections, that is to say in particular coaxial plug-in connections, are used in many technical fields of application, in particular in the field of high-frequency technology.

In this context, plugs with protruding internal conductors and with couplings (if they are each attached to the end of a cable) are distinguished. A plug which is installed in an appliance housing is often referred to as a built-in plug. A coupling which is installed in a housing is generally referred to as a socket for short.

For example, EP 1 724 877 A2 discloses a weldable coaxial plug-in connector which can be attached to the end of a coaxial cable. In a known manner, if comprises an Infernal conductor and an external conductor, which at the same time constitutes the external conductor housing.

US 2008/0 261 446 A1 discloses a housing socket which comprises a square fixing flange having screw holes positioned in the corner regions, so as to be able to attach the housing socket which is formed in this manner to a housing of an appliance. In a known manner, the internal conductor socket is held by an insulator in the interior of a sleeve-shaped external conductor socket, the entire arrangement consisting of the internal conductor and the external conductor being accommodated in a connection housing, which is formed integrally with the fixing flange and has an external thread.

A housing socket and a housing plug which are similar in these respects are also known from DE 10 2005 039 458 B4.

An HF housing coupler is also disclosed in DE 10 2007 016 430 B4. This HF housing coupler comprises a sleeve-shaped connection piece, to which a coaxial plug can be connected firmly but releasably in a known manner.

As an improvement, this prior publication proposes that the sleeve-shaped connection piece for receiving the internal and external conductor of the housing coupler comprises at least one region which enters a positive connection, at least in portions, with a housing wall of the electrical/electronic appliance.

In this context, the connection piece itself may consist of metal materials, or at least materials which contain metal, whereas the housing of the electrical/electronic appliance itself consists of plastics material, which is produced by means of an injection moulding process or a process related to the injection moulding process, in which flowable plastics material cures In a shape which can be predetermined.

Since a high-frequency application is generally involved, it is further provided that the housing of the electrical/electronic appliance is provided with a metallised surface, at least in a sub-region.

The use of plastics material for the electrical/electronic housing provides good corrosion properties on the one hand, and on the other hand also contributes to the prevention of intermodulations as a result of undefined contact points on the contacts to the HF socket part (HF coupler). In addition, the use of plastics material generally also contributes to a reduction in the costs, since plastics material can be considered a cost-effective material.

However, it should be noted that, disadvantageously, the outer thread of an HF connection housing of this type is subjected to considerable forces, since the external conductors of the coaxial cable to be connected on the housing socket which are to be contacted are to be pressed against one another with high compression forces, so as to provide intermodulation-proof contact. In addition, the internal conductor contact of the internal conductor portions which are to be contacted with one another should also be protected against relative movements when external forces act (for example if a coaxial cable to which the HF coupler is connected is moved). Finally, it should also be noted that under increasing loads, plastics materials have a constantly increasing tendency towards cracking, and in general are not always able to transfer stresses in the long term under varying temperature influences (problem of what is known as relaxation).

DE 197 46 637 C1 discloses an HF coaxial angle plug-in connector, in which a plurality of HF couplers are arranged.

DE 699 02 947 T2 discloses a coaxial connection means which has a plurality of connection sleeves on one housing.

Finally, DE 12 46 077 describes and discloses a high-frequency tight coupling in which all of the shielding components are enclosed by an insulating material.

By contrast, the object of the present invention is to create an improved wall-shaped HF assembly, that is to say formed for example on a cover or a housing wall of a housing, comprising at least two HF housing couplers, in particular for a connection cover of an antenna means, which can be used for example in a mobile radio antenna system of a base station.

The object, is achieved according to the invention in accordance with the features which are specified in claim 1. Advantageous embodiments of the invention are specified in the dependent claims.

The present invention provides a considerable advantage by comparison with the prior art. In the solution according to the invention, the HF housing couplers are formed on a housing or cover, generally on a wall-shaped HF assembly, which can be used for example as a wall-shaped or cover-shaped lower installation flange on a radome of an antenna. In a known manner, generally a plurality of coaxial cables, via which the HF transmission and reception signals are passed to the antenna or from the antenna to the base station, are to be attached to a cover of this type, which may also be referred to in the following as a housing cover or a housing or cover flange. Moreover, further connection points may be provided, for example for additional electrical/electronic components, such as what is known as an RET unit, by means of which a downtilt angle (that is to say an adjustment in the vertical direction) or the pivoting of the main lobe in the horizontal direction can be set differently remotely, for example by using phase shifters.

On the one hand, the solution according to the invention is distinguished in that, by contrast with the generic prior art, a material which consists of a metal, electrically conductive material is used for the housing or the cover, that is to say generally again for the wall-shaped HF assembly.

In addition, in the solution according to the invention, the housing of the HF couplers (which serves to accommodate the internal and external conductor of a plug-in connector) is formed integrally with the housing or cover by means of a material connection. That is to say, the housing-shaped, cover-shaped and/or wall-shaped HF assembly is manufactured together with the coupler housings (which generally project from the corresponding housing wall or the cover in a hollow cylindrical shape) in one working step, and is thus connected to the housing-shaped, cover-shaped and/or wall-shaped HF assembly. This reliably prevents intermodulation problems, but also provides that high mechanical forces can be absorbed safely by this construction, without the entire electrical connection or mechanical components potentially being detrimentally affected, even if high forces occur. In the context of the invention, this also prevents contact corrosion, which occurs in the prior art (since in the prior art a corresponding flange is screwed onto a cover).

At the same time, however, the surface for example of the housing or cover and the surface of the HF connection sleeve are provided with an electrically non-conductive surface coating. This non-conductive surface coating should preferably consist of very hard and/or corrosion-resistant material, for example a hard anodised aluminium layer.

This non-conductive, preferably very high and/or corrosion-resistant surface coating is provided at least in the insertion region, that is to say in the receiving region of the HF connection sleeve into which a coaxial plug-in connector, for example in the form of a coaxial plug-in means or coaxial socket means comprising an internal and external conductor, is inserted, spacing insulating parts, insulating rings, insulating sleeve portions etc. preferably also additionally being provided between the external conductor and the internal wall of the HF connection housing.

This construction additionally has the advantage that for example an electrical coaxial plug-in means which is correspondingly accommodated in an HF connection sleeve can be removed and replaced with another plug or another socket as required, without the housing or the cover of an electrical/electronic appliance or for example of an antenna means having to be opened. This creates a connection which is easy to release and which, above all, does not lead to any damage as a result of the compression of cooperating components.

Finally, housing and/or cover constructions which are built in this manner and absorb large forces (that is to say in general the HF assembly under discussion) can additionally also further comprise mounting portions, for example in the form of support webs etc., on which a cover construction which is formed in this manner can be connected to other housing components in an optimum manner, for example to an antenna cover, a reflector of an antenna means etc.

The same applies to any further mounting portions which may be formed on the housing and/or cover, for example in particular if a construction of this type is used in connection with an antenna means and is intended to be used as a mounting unit for attaching to a mast.

Equally, a housing/cover construction of this type can also be used for accommodating further interfaces, for example to the aforementioned RET units, in such a way that in this case correspondingly prepared, generally cylindrical or cylinder-like connection housing portions, which are connected integrally, that is to say in a material connection, with the housing/cover can be used for connecting further units.

Any suitable plug-In connectors are possible as plug-in connectors, that is to say as HF couplers. In the field of antenna technology, what are known as 7/16 cable plugs and sockets are often used. However, the invention can also be used in connection with other connectors, in particular other standardised connectors, such as 4.1 to 9.5 connectors, N connectors etc.

The invention is explained in greater detail in the following by way of examples, in which, in detail:

Figure 1:
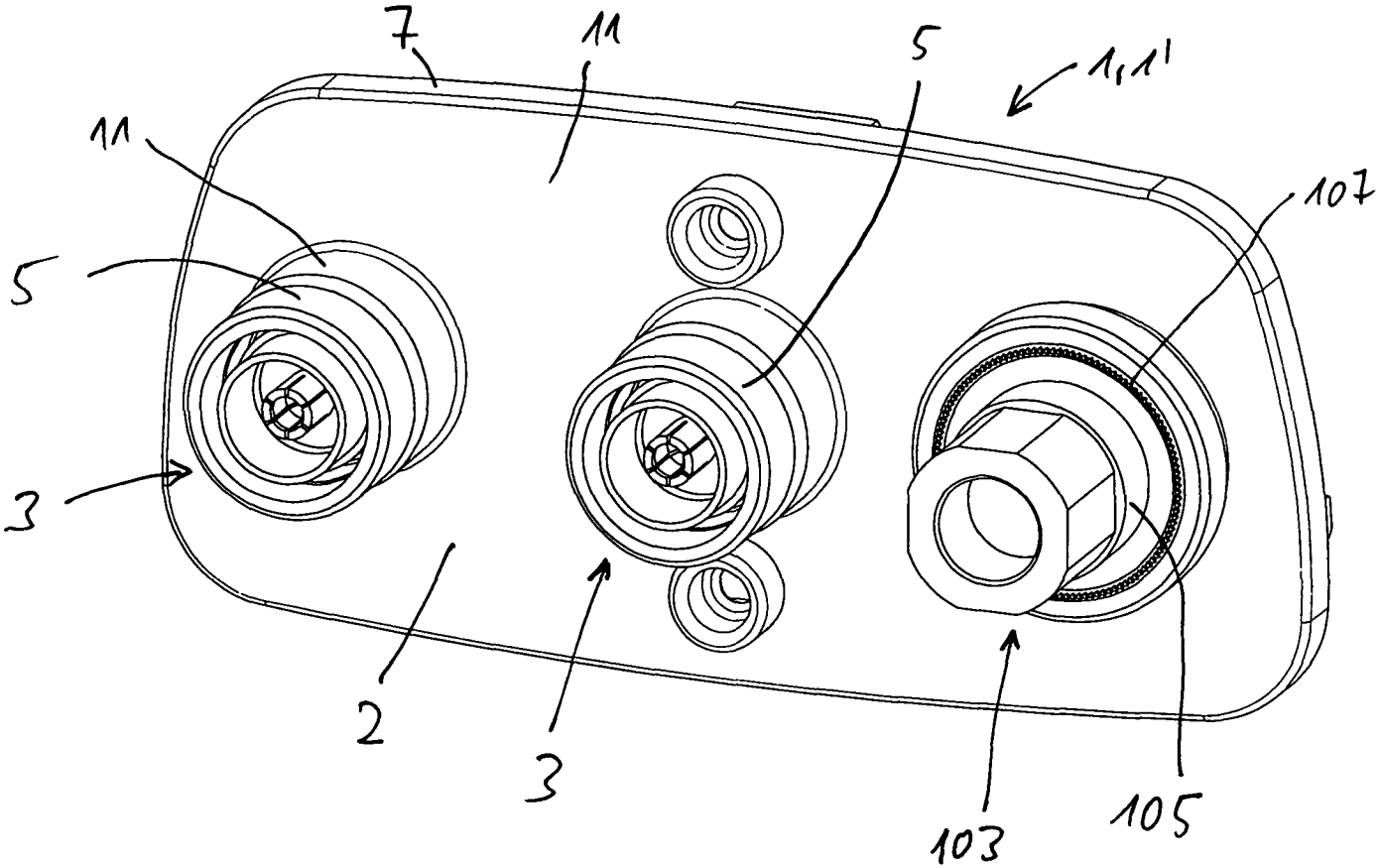
FIG. 1 is a schematic three-dimensional external view of a portion according to the invention of a housing/cover, with connection housings thereon, in the form of HF connection sleeves, which project in the viewing direction.
Figure 2:
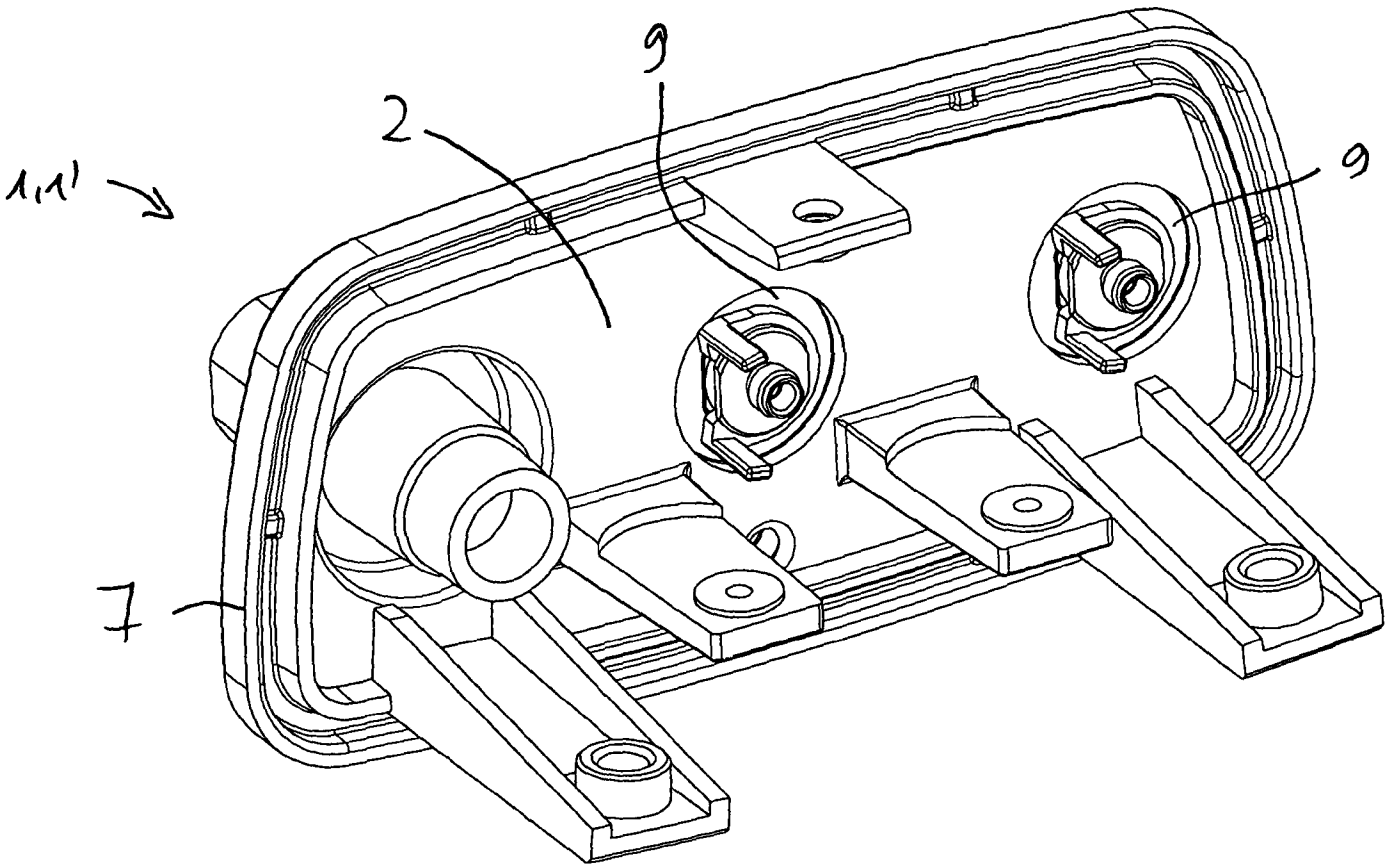
FIG. 2 is a corresponding rear view of the embodiment according to FIG. 1.

FIG. 1 is a schematic perspective front view and FIG. 2 is a corresponding rear view of a cover 1', which may be part of a housing. Instead of this cover 1', a connection wall or housing wall or a housing itself may be provided. Therefore, in the following, reference is simply made to the housing/cover 1' for an electrical/electronic device or of an HF assembly, in particular of a wall-shaped HF assembly 1. In the present case, this is a flange-like housing and/or cover construction 1' comprising a mounting wall 2, such as is used for example for an antenna means. In an antenna means, which is mounted on an antenna mast in a conventional manner, having a vertically extending radome, a housing/cover construction 1' as shown in FIGS. 1 and 2 can be provided pointing downwards, since in this context the corresponding interfaces are formed for connecting coaxial cables.

In the embodiment shown, two interfaces 3 and a connection interface 103, explained in greater detail below, are shown in the wall-shaped HF assembly, and are formed in the manner of HF connection housings, which may also be referred to in the following as connection sleeves 5. That is to say, they are of a hollow cylindrical shape and are used—as will be discussed in greater detail—for connecting for example coaxial plugs or sockets, which may also be referred to in the following as HF couplers. The wall-shaped HF assembly 1 may for example have a peripheral rim 7, with which the wall-shaped HF assembly can be assembled with and connected to a remaining part (not shown in greater detail) of a housing, for example an antenna housing (radome). In the figures shown, a double rim 7 is provided for this purpose, forming an intermediate groove. However, this is Irrelevant for explaining and understanding the invention.

In the mounting wall 2, three mutually offset connection openings 9 are formed, in the region of which the hollow cylindrical HF connection housings 5 which project outwards in this embodiment are arranged.

Figure 6:
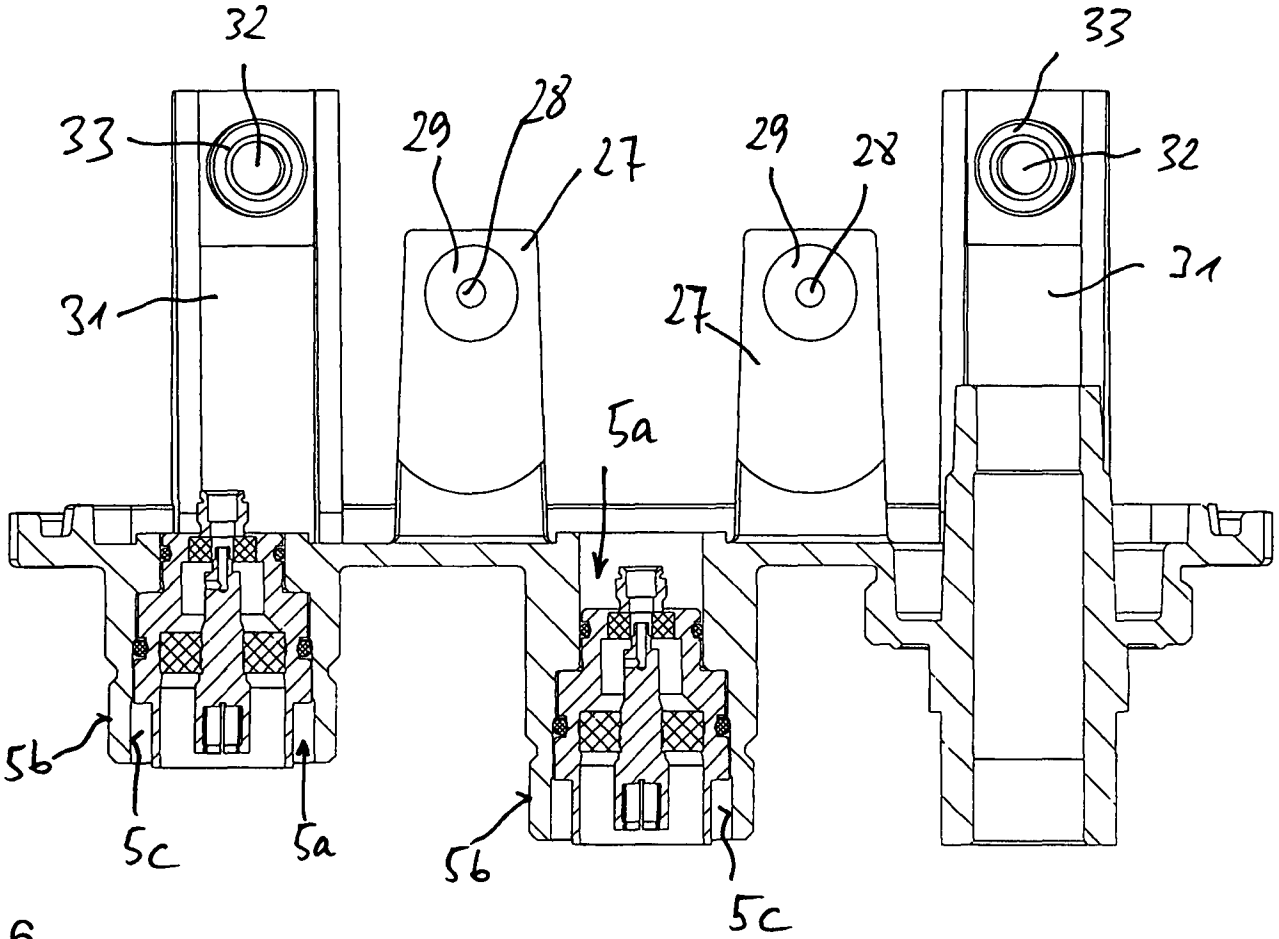
FIG. 6 is a view which is similar to FIG. 5 in which the central HF connection housing is of a greater axial length.

As can already be seen from the perspective sectional view according to FIG. 6, the wall-shaped HF assembly 1 in the form of the housing/cover means 1' is formed integrally, that is to say with a material connection, with the mounting wall 2 and the HF connection sleeves which project outwards in this embodiment. In other words, the housing/cover means 1', that is to say the wall-shaped HF assembly 1 along with the mounting wall 2 and connection sleeves 5 thereof, is manufactured in a single unitary manufacturing process as a materially connected unit (material connection).

This unit consists of a metal material, that is to say an electrically conductive material, which is also suitable for absorbing appropriately high forces. Therefore, the mounting wall 2 is preferably manufactured in a casting process together with the associated HF connection sleeves 5. Aluminium is a possible example of a material.

Therefore, a corresponding aluminium part or other metal part can also be manufactured as a milled part, at least in part.

The unit which can be seen in the figures and which is also referred to in the following as the HF assembly, consisting of the mounting wall 2 and the associated HF connection sleeves 5, is also coated completely or at least in portions with a non-conductive surface coating 11. This non-conductive surface coating should preferably consist of a very hard material which further consists of as corrosion-resistant a material as possible, for example of a hard anodised aluminium layer.

This coating 11 should be provided at least in the axial receiving ducts 5*a* of the hollow cylindrical HF connection sleeves 5, so as to provide electrical contacting there between the coupling connectors which are to be used there and the mounting wall 2 having the associated connection sleeves 5. Preferably, the entire surface of the HF assembly 1 is coated with the costing 11 as a whole, that is to say the front face, the rear face and the peripheral rim of the mounting wall 2 and the external and internal faces of the connection sleeves 5. In any case, individual installation or mounting faces, which will be described in greater detail in the following, may have a worked surface so as provide a metal connection surface there.

Figure 3:
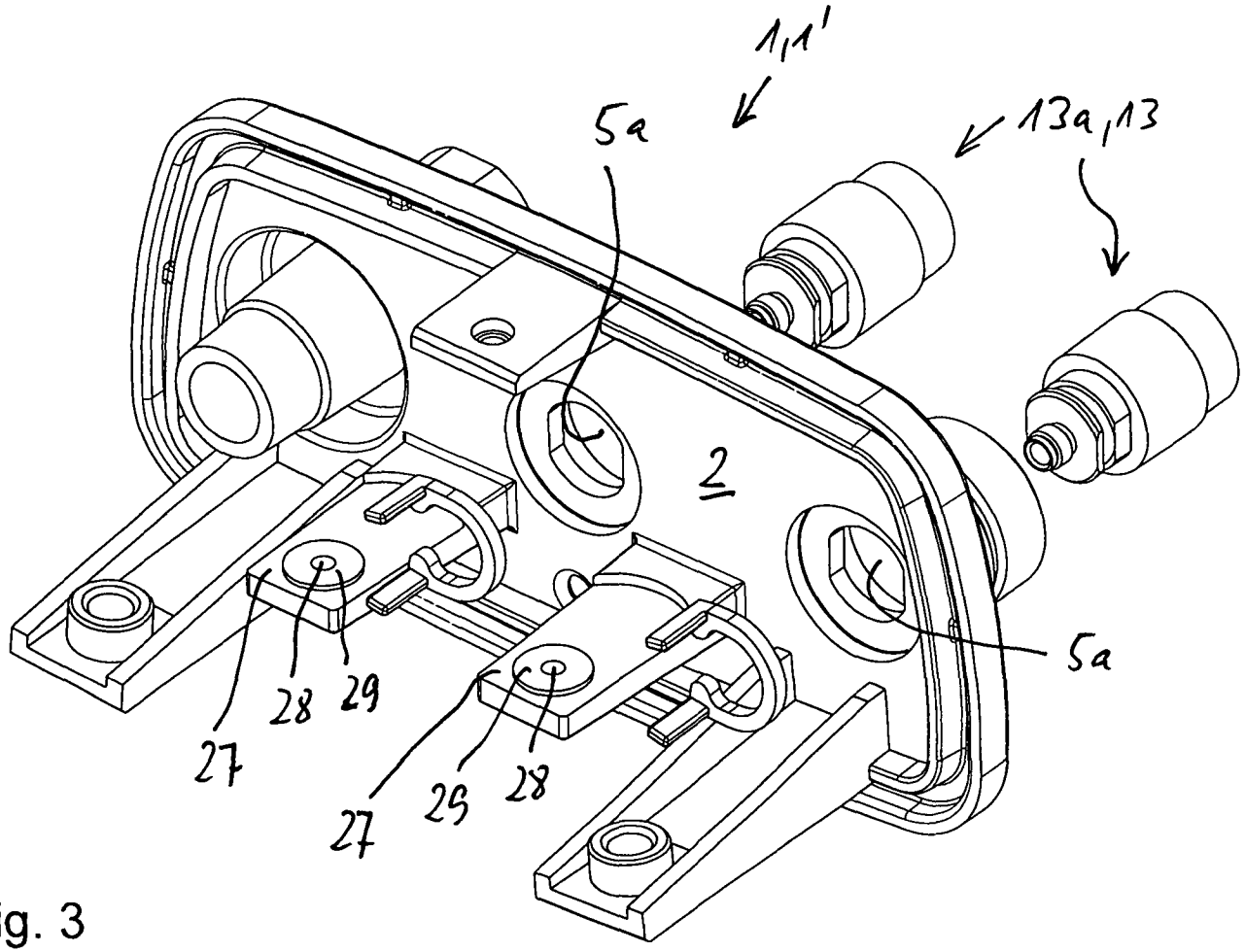
FIG. 3 is likewise a rear view similar to FIG. 2, additionally showing two coaxial couplers which have not yet been installed.
Figure 4:
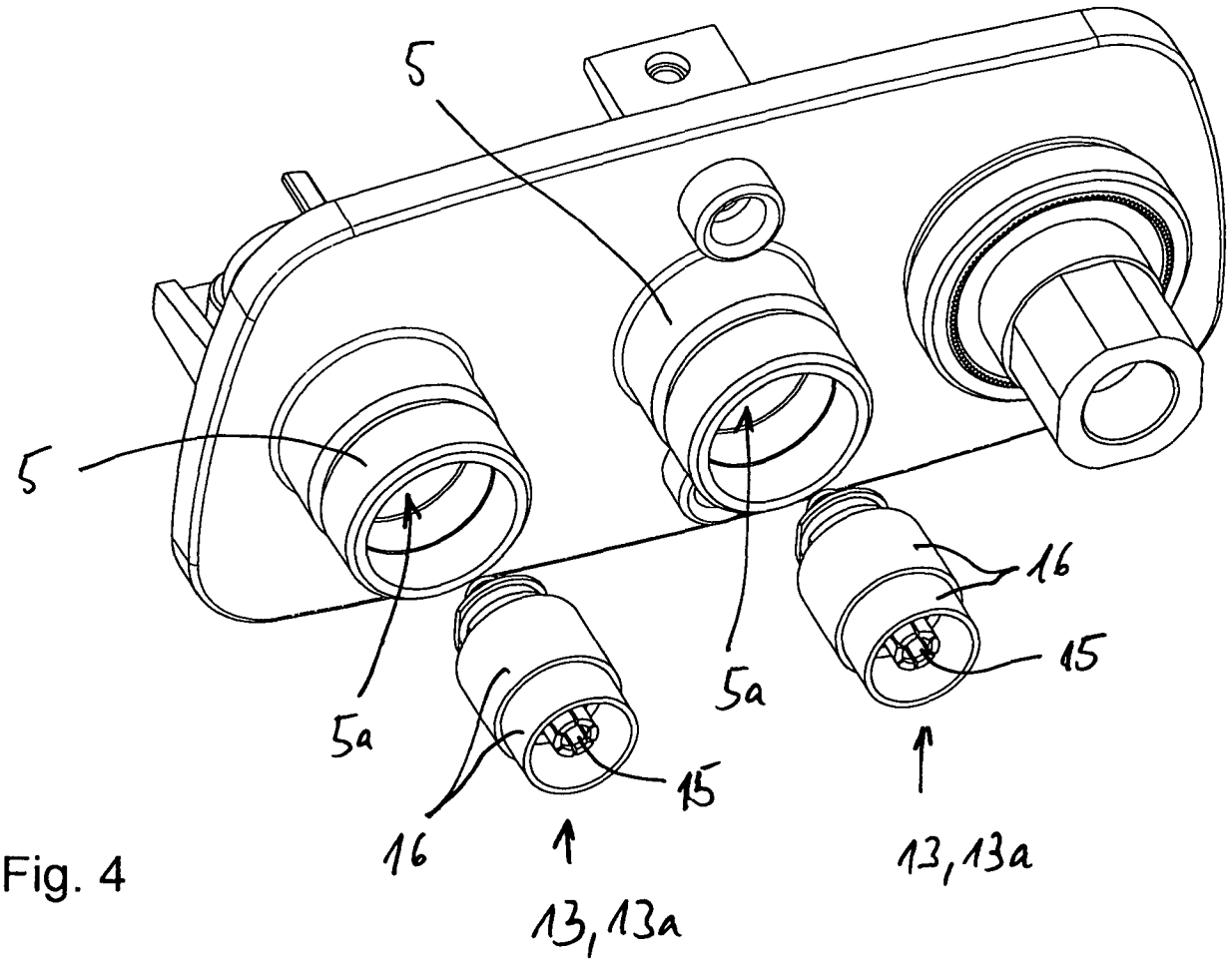
FIG. 4 is a corresponding view, but from the front, of the embodiment according to FIG. 3 with two coaxial couplers which have not yet been installed.

FIGS. 3 and 4 show, in a schematic rear view and a schematic front view, that for example two coaxial plug-in connectors 13 (couplers), for example in the form of a cable socket unit 13*a*, should be installed in the axial receiving ducts 5*a*, that is to say only the HF parts of a plug-in connection of this type (without the additional coupler housing which would otherwise be required in the prior art, comprising the HF components). Thus, for this purpose, coaxial plug-in connectors 13 of this type, that is to say what are known as HF couplers 13 comprising an internal conductor 15, an external conductor 16 and one or more insulators 17 which hold the internal conductor 15 out of contact with the external conductor 16, are used, specifically, in contrast with the prior art, without additional housings, which conventionally enclose, the internal and external conductors and which are generally provided with an external thread (for example an M29 external thread).

The aforementioned coaxial plug-in connectors may for example be a 7/16 cable socket unit, but are not limited thereto.

Figure 7:
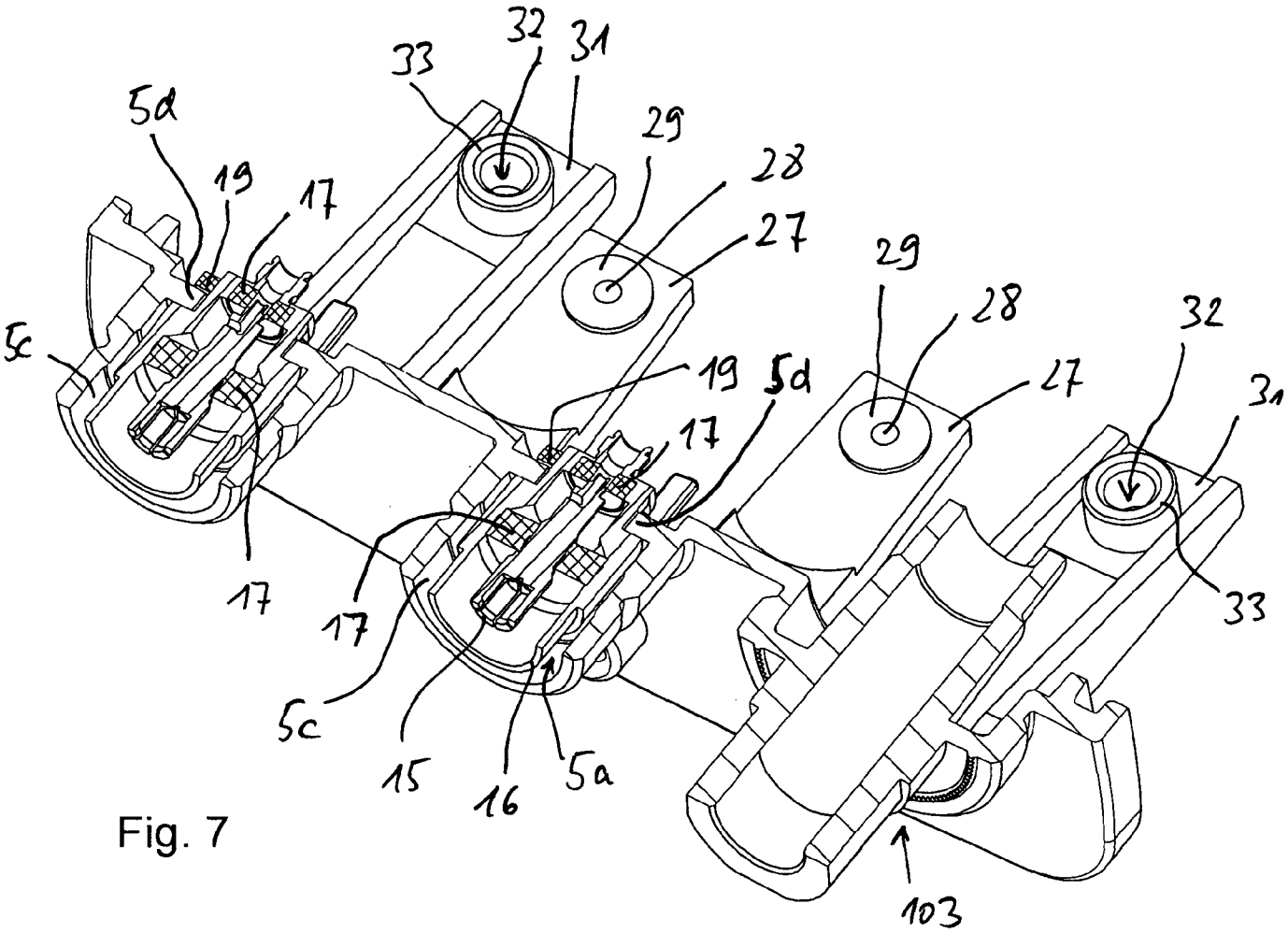
FIG. 7 is a three-dimensional sectional view of the embodiment according to FIG. 5 but with slight differences.

These plug-in connectors or socket units 13, that is to say the HF couplers 13, may be inserted with or without welded-on coaxial cables (not shown in greater detail in the drawings) into the sleeve-like outer contour in the form of the HF connection housing, and secured on the rear side by means of a securing part 19, for example in the form of a plastics material part or an insulating metal part, in such a way that, as a result of the insulating surface layer 11 of the housing/cover assembly 1', no galvanic contact is possible between the coaxial plug-in connector or cable socket unit and the housing/cover assembly 1', that is to say the wall-shaped HF assembly 1 (FIG. 7).

The sleeve-like outer contour in the form of what is known as the HF connection sleeve 5 can be provided with a conventional external thread 5*b* of a conventional 7/16 socket, in such a way that in this case a corresponding cable connector comprising an internal thread can, as is also the case in a conventional plug-in connector, be screwed onto the external thread 5*b* of the HF connection housing 5, specifically with corresponding contacting between the two internal conductors and the two associated outer conductors.

Figure 5:
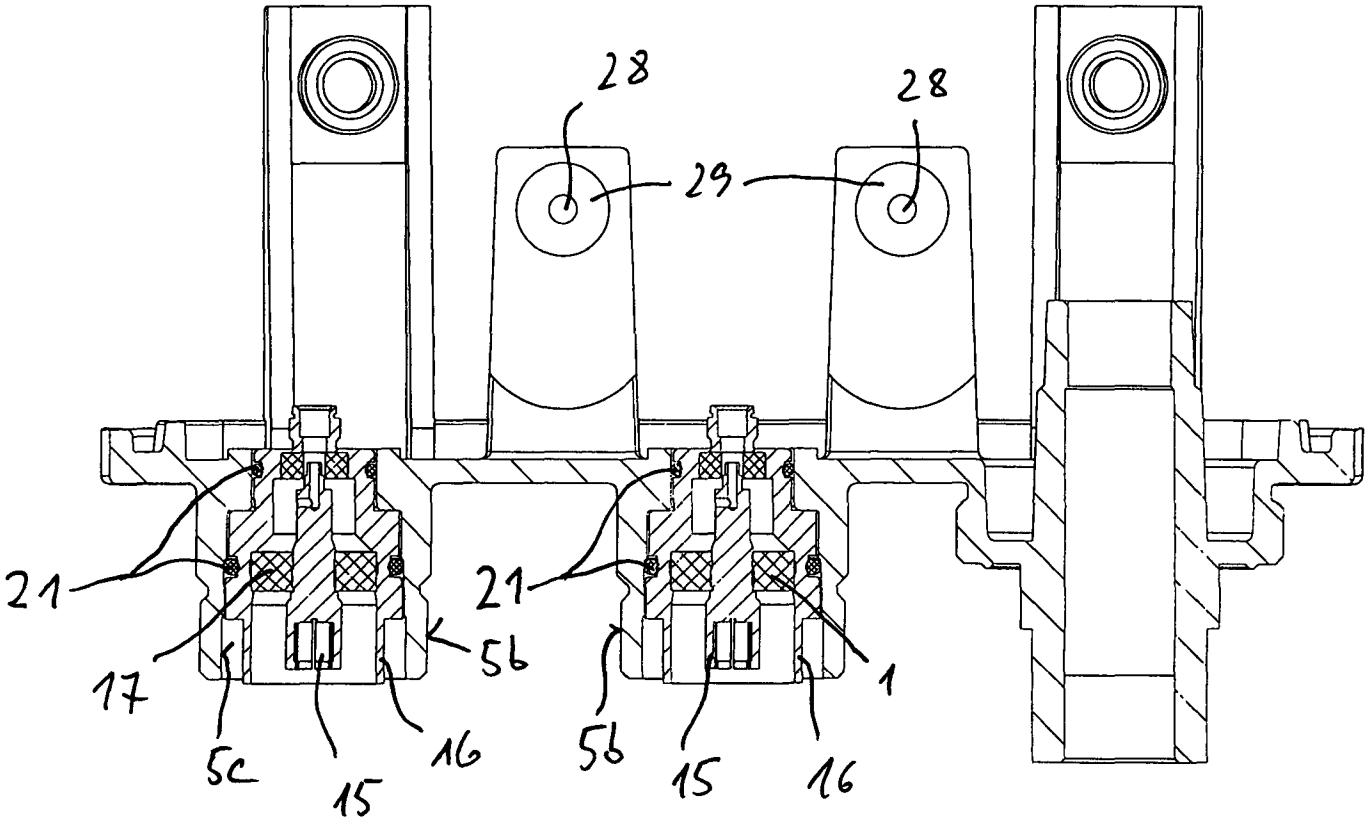
FIG. 5 is a horizontal sectional view at the level of the internal conductor of the housing/cover according to the invention, comprising two installed coaxial couplers which are also shown in section.

As can already be seen by comparing FIGS. 5 and 6, the HF connection sleeves 5 may be formed with different axial lengths, specifically in the form of a short version or a longer embodiment which is also referred to as the "long neck" version. Otherwise, any desired and/or expedient plug-in connector lengths (socket lengths) may be provided.

From the slightly different embodiments according to FIGS. 5 and 6 on the one hand and FIG. 7 on the other hand, it can also be seen that insulating rings or insulating collars 21 can be inserted, for example between the outer circumference of the outer conductor 16 of the coaxial HF coupler 13, that is to say the socket unit 13*a* which is installed there, and the cylindrical internal wall 5*c* of the HF connection housing 5, and keep the external conductor 16 of the plug-in connector 13 at least a small distance away from the internal wall 5*c* of the HF connection housing 5. The variant according to FIG. 7 shows that the centering and axial securing of the installed socket, and thus of the external conductor 16, can also be provided by means of the rearward stop construction, that is to say the inward-facing annular shoulder 5*d* in the axial receiving duct 5*a* of the HF connection housing 5, in that the aforementioned securing parts 19 of the installed plug-in connector/socket are Inserted on the housing rear face behind the annular shoulder 5*d*.

Instead of rearward securing of this type, releasable fixing/pressing or fitting can also be provided from the front face, for example via an insulating insert, in such a way that a corresponding HF insert cannot fall out.

It is noted as a basic principle that the HF coupler 13, that is to say the coaxial plug-in connector 13, can also be provided with a peripheral rim on the outer surface thereof, which produces galvanic contact with the housing by breaking up the hard anodised aluminium layer, when what is known as "press mounting" to the internal wall 5*c* of the axial receiving duct 5*a* of an HF connection housing 5 is provided. However, this is a less mounting-friendly solution than the one described above.

A major advantage of the described construction is that the mechanical function is separated from the electrical function in the region of the plug-in connectors. This is because on the one hand the mechanical function is provided in such a way that a high, constant surface contact pressure is produced in the region of the plug-in connector on the external conductor which is to be contacted, specifically in that a metal material (for example aluminium or another metal or another alloy) which is provided with a hard and also non-conductive surface, on which the external thread is formed, is used for the housing/cover assembly 1' along with the associated integral HF connection housings, that is to say the connection sleeves 5. The separate electrical functional unit, in the form of the plug-in connector or the socket which is installed in the HF connection housings which are associated with the housing/cover assembly, is separate from this assembly and can also easily be replaced, without the relevant HF assembly 1, that is to say the housing/cover assembly 1' as part of a whole housing, having to be opened, as would otherwise be the case. This virtually makes It possible to carry out corresponding repairs on the housing which is provided with the mounting wall 2 according to the invention, such as an antenna housing (radome) among others, for example in the region of the plug, without having to open the antenna housing. Since the external conductor sleeves 5 and the mounting wall 2 are also formed as a materially unitary part, no potential differences can occur in this part (since it is in fact made of metal and is electrically conductive), and as a result intermodulation problems such as occur in the prior art can be prevented. The relevant mounting wall, comprising the connection sleeves and the installation components, which are explained in greater detail in the following, for example in the form of support webs etc., may for example be manufactured well as cast metal, in particular as cast aluminium.

In addition, the electrical socket unit, that is to say the coaxial plug-in connector unit 13 or what is known as the HF coupler 13, is formed by a stop 5*e* In the form of a shoulder which projects inwards info the axial receiving duct 5*a*, against which the electrical socket unit is positioned or strikes, in such a way that as a result of the high hardness and strength of the material no setting and flowing is possible (such as is found as a drawback in housing/cover constructions consisting of plastics material).

Further, during the mounting and dismounting of the socket unit and the plug-in connector, it can be made possible to exchange a defective plug-in connector very easily and rapidly merely by joining and/or releasing a cap, of a plug-in connector which is to be contacted, which is screwed onto the external thread 5*b* of the connection housing 5, it being possible for the housing cap, which is screwed onto the external thread 5*b*, of a plug-in connector or plug also to consist of metal, or else of plastics material.

Finally, it can also be seen from the drawings that the housing/cover assembly of a metal construction with the hard and/or preferably non-corroding surface coating also provides the possibility of providing additional functions.

Finally, it is also further noted that mechanical twist-proofing for the inserted HP coupler 13, that is to say the plug-in connector 13, relative to the HF connection housing 5 is provided, for example in the form of two opposed planar faces, which are formed on the one hand on the HF coupler 13, the HP plug-in connector 13, and on the other hand by two opposing planar faces in the receiving channel 5*a* of the HF connection housing 5.

Thus, two support webs 27 are provided on the rear face or inside, are formed with spacing and project rearwards from the mounting wall 2 of the mounting assembly 1, and on which for example a reflector (not described in greater detail) of an antenna means or another support wall, earth plane etc. can be tested and in particular screwed on. The support webs 27 comprise corresponding, slightly raised support surfaces 29 surrounding holes 28, it being possible to work these support surfaces 29 from the surface in such a way that any electrically non-conductive coating which may have been applied previously is not worked off here. As a result, an optimum galvanic/electric contact can be produced for example to an electrically conductive reflector of an antenna means.

Finally, it can also be seen from the drawings that two further spaced holding and/or fixing webs 31 are also provided, and in this case are provided further outwards on the housing/cover assembly and also project in a rearward direction parallel to the support webs 27, in the embodiment shown actually also with a larger axial dimension. These holding/fixing webs 31 may for example be used to fix the housing/cover assembly 1' on a mast (not shown in greater detail), and thus constitute a mechanical and electrical connection to a mast mounting. For this purpose, pressed-in threaded nuts 33 are also provided in the openings 32 or holes 32 which pass through the holding and fixing means 31, so as to screw in fixing screws of a mast mounting here.

Merely for completeness, it is noted that another further Interface 103 is also provided on the aforementioned housing/cover assembly 1, in particular for example an interface for an RET unit as mentioned above, which can be used for example for setting a downtilt angle or for horizontally pivoting a main lobe of an antenna means. In this context, merely the hollow cylindrical connection housing, means 105 for an RET unit of this type is shown, that is to say a corresponding connection sleeve 105, which like the other aforementioned connection sleeves 5 is formed materially connected to and thus integrally in a single manufacturing process with the mounting wall 2 and the further support webs 27 as well as the fixing webs 31, in particular in a casting process, for example as mentioned as a cast aluminium component (manufacture as a cast metal part also being possible by using another metal or another alloy).

In this context for example individual surface portions, such as the peripheral rib-shaped contact ring shown in FIG. 1 or the corresponding contact surface 107, can also additionally be processed or worked in such a way that no electrically non-conductive coating is provided there, but instead the blank metal surface of the mounting plate or the connection sleeve 105 is visible, so as to interact or be in contact with a corresponding installation component (for example the aforementioned RET component) mechanically and if applicable electrically/galvanically.

The invention claimed is:

1. A wall-shaped high frequency (HF) assembly comprising:

a mounting wall comprising a metal, electrically conductive material, in the mounting wall, at least two connection sleeves positioned mutually offset are each provided with a receiving duct which passes axially through the connection sleeves and into each of which an HF coupler comprising an internal and an external conductor is inserted, the mounting wall and the at least two connection sleeves comprising the same metal, electrically conductive material, the at least two connection sleeves being formed integrally with the mounting wall, in the form of a material connection, the mounting wall and the at least two connection sleeves being provided with an electrically non-conductive surface coating, wherein the mounting wall and the at least two connection sleeves comprise or consist of a cast part or a milled part, and at least one further component provided on the rearward face of the mounting wall and formed integrally with the mounting wall in the form of a material connection, the further component comprising at least one fixing web or support web configured for mounting an installation component.

2. The wall-shaped HF assembly according to claim 1, wherein the electrically non-conductive surface coating is formed continuously at least on an internal wall of the connection sleeves.

3. The wall-shaped HF assembly according to claim 1, wherein the mounting wall and the connection sleeves are covered completely with the electrically non-conductive surface coating, excluding exposed and/or worked-off metal regions.

4. The wall-shaped HF assembly according to claim 1, wherein the electrically non-conductive surface coating consists of or comprises corrosion-resistant material.

5. The wall-shaped HF assembly according to claim 1, wherein the mounting wall and the connection sleeves consist of a cast metal component, of cast aluminum or aluminum which is coated with the surface coating at least in places.

6. The wall-shaped HF assembly according to claim 1, wherein the HF coupler which is inserted into the axial receiving duct of each connection sleeve is secured against axial removal by a rearward securing component.

7. The wall-shaped HF assembly according to claim 1, wherein the coupler units which are inserted into the axial receiving duct of the at least two connection sleeves are secured against axial removal counter to the connection direction of a cable, by releasable fixing or pressing or fitting, by an insulation insert.

8. The wall-shaped HF assembly according to claim 1, further comprising at least one further connection sleeve formed integrally in a material connection with and connected to the mounting wall, and provided as an interface for further installation components.

9. The wall-shaped HF assembly according to claim 1, further comprising an external thread formed on each outer circumference of the at least two connection sleeves.

10. The wall-shaped HF assembly according to claim 1, wherein the at least one further component comprises at least two mutually offset support webs provided as further components on the rear face of the mounting wall for mounting the installation component.

11. The wall-shaped HF assembly according to claim 10, wherein the support webs are provided with a hole in the region of which a raised portion is formed as an uncoated and electrically contactable support and contact surface.

12. The wall-shaped HF assembly according to claim 11, further comprising a hole, in the region of which a threaded nut is pressed in, formed in at least one of the support webs.

13. The wall-shaped HF assembly according to claim 12, further comprising mechanical twist-proofing for the HF couplers in the associated axial receiving duct of the connection sleeve in the form of a depression or elevation which deviates from rotational symmetry and which corresponds to a corresponding elevation or depression on an internal wall of the receiving duct of the connection sleeve, in the form of cooperating planar faces.

14. The wall-shaped HF assembly according to claim 1, wherein the at least one further component comprises at least one fixing web provided on the rear face of the mounting wall.

15. The wall-shaped HF assembly according to claim 1, wherein the surface coating consists of or comprises a hard anodized aluminum layer.

16. A radio frequency assembly comprising:

a mounting wall comprising a metal, electrically conductive material, first and second connection sleeves positioned and mutually offset from one another in the mounting wall, the first and second connection sleeves being integrally cast or milled with the mounting wall and comprising the same metal, electrically conductive material as the mounting wall;

the first and second connection sleeves each defining receiving ducts which pass axially therethrough, the first connection sleeve receiving duct being structured to accept a first radio frequency coupler having internal and external conductors, the second connection sleeve receiving duct being structured to accept a second radio frequency coupler having internal and external conductors;

an electrically non-conductive surface coating disposed on the mounting wall and the first and second connection sleeves; and at least one further component is provided on the mounting wall and formed integrally with the mounting wall in the form of a material connection, the further component comprising at least one fixing web or at least one support web configured for mounting an installation component.

* * * * *